US006325144B1

(12) United States Patent
Turley et al.

(10) Patent No.: US 6,325,144 B1
(45) Date of Patent: Dec. 4, 2001

(54) INFLATABLE PACKER WITH FEED-THRU CONDUITS

(75) Inventors: Rocky A. Turley, Houston; Greg C. Badke, Conroe; John A. Edwards, Houston, all of TX (US)

(73) Assignee: Baker Hughes, Inc., Houston, TX (US)

( * ) Notice: Subject to any disclaimer, the term of this patent is extended or adjusted under 35 U.S.C. 154(b) by 0 days.

(21) Appl. No.: 09/590,926

(22) Filed: Jun. 9, 2000

(51) Int. Cl.[7] ..... E21B 23/04
(52) U.S. Cl. ..... 166/120; 166/133
(58) Field of Search ..... 166/120, 122, 166/126, 132, 133, 147, 195, 65.1, 106

(56) References Cited

U.S. PATENT DOCUMENTS

| | | | | |
|---|---|---|---|---|
| 4,798,243 | * | 1/1989 | Curington et al. | 166/65.1 |
| 5,048,610 | * | 9/1991 | Ross et al. | 166/372 |
| 5,230,383 | * | 7/1993 | Pringle et al. | 166/66.4 |
| 6,173,788 | * | 1/2001 | Lembcke et al. | 166/387 |
| 6,220,362 | * | 4/2001 | Roth et al. | 166/380 |
| 6,223,821 | * | 5/2001 | Coronado | 166/250.01 |

FOREIGN PATENT DOCUMENTS

1402119 * 4/1902 (FR) .

* cited by examiner

*Primary Examiner*—Frank S. Tsay
(74) *Attorney, Agent, or Firm*—Madan, Mossman & Sriram, PC

(57) ABSTRACT

An expandible packer provides a crescent-shaped cross-sectional area for more and larger diameter data cable and fluid control conduits by eccentrically offsetting the packer mandrel relative to the expandable element. The expandible element of the packer eccentrically surrounds the mandrel to provide an eccentric volume zone between the packer collars. One or more data cable or fluid carrier conduits may be laid between the collars within this eccentric zone, all of greater diameter than would be possible within an annulus between two concentric mandrels. The eccentric zone conduits are secured and protected by a compliant filler material such as rubber or other elastomer that is applied around and between the control conduits within the eccentric zone. This filler material is trimmed or cast to a substantially cylindrical surface about an axis that is substantially coextensive with the expandable element axis.

12 Claims, 3 Drawing Sheets

INFLATABLE PACKER WITH FEED-THRU CONDUITS

BACKGROUND OF THE INVENTION

1. Field of the Invention

The present invention relates to the earth boring arts. In particular, the invention relates to a well annulus packer having a plurality of independent conduits passing through the packer whereby the packer seal integrity is maintained with the casing wall or well bore.

2. Description of the Prior Art

"Packer" is the term given to an apparatus for axially separating adjacent sections of a borehole or casing annulus with a fluid-tight barrier. Usually, the packer is combined with one or more additional tools such as a slip that is set to hold the packer in place.

The set of a packer is often merely one step in a well working procedure that is either preceded or followed by other procedures and manipulations either above or below the packer. Commonly, pressure and/or temperature measurements from either above or below the packer are transmitted to the surface. Usually, such data is carried on electrical or fiber optic data transmission cable. In other cases, power transmission fluid is delivered to and returned from a downhole fluid motor.

Operational circumstances as described above require one or more sealed conduits across the packer barrier. In the past, such by-pass conduits have been routed through an annulus between a concentric pair of cylindrical mandrels. The inner mandrel serves as the inner conduit for primary well production flow, for example. The outer mandrel serves as the internal base surface for an expandable packer element. An annular space between the inner and outer mandrels routes the fluid or data carrier conduits. That portion of the annular space between the conduits is filled with some form of filler material to maintain a seal between the upper and lower bore zones.

As the need arises for larger fluid and data transmission cable, an increased inter-mandrel annulus is essential to accommodate the increased cable size. However, an increased inter-mandrel annulus requires a larger expandable element mandrel. If the prior art pattern is followed, it is ultimately necessary to increase the borehole size to accommodate larger data cable or fluid circulation conduits: an exponentially expensive consequence.

It is, therefore, an objective of the present invention to provide larger packer feed-through conduits than is possible by prior art techniques without increasing the borehole or casing size.

Another object of the invention is a packer feed-through technique that eliminates the necessity for a second mandrel in the assembly.

A still further object of the invention is to more efficiently use the annulus area between a packer mandrel and the expandable element.

SUMMARY OF THE INVENTION

The invention addresses these and other objects as will be apparent from the following detailed description wherein the expandable element of the packer and the mandrel are eccentrically aligned. Such an alignment provides an eccentric annulus sector having a greater maximum thickness between the mandrel O.D. surface and the retracted I.D. surface of the expandable element than is geometrically possible with a coaxial construction. External data and fluid circulation or control conduits are routed through the enlarged eccentric sector of the annulus.

The packer end collars are fabricated eccentrically whereby the axis of the mandrel is offset from but parallel with the expandable element axis. Fluid circulation or control conduits are secured to the outer surface of the mandrel along the arc of the of the eccentric area. The mandrel and attached fluid circulation lines are protected by an overlay of rubber/elastomer filler compound. The overlay surface is faired to approximate concentricity about the expandable element axis. The packer inflation element is secured to the end collars around the faired filler.

BRIEF DESCRIPTION OF THE DRAWINGS

Preferred embodiments of the invention are described by reference to the drawings wherein like reference characters are used to describe like or similar elements throughout the several figures of the drawings and.

DETAILED DESCRIPTION OF THE PREFERRED EMBODIMENTS

Figure 1:
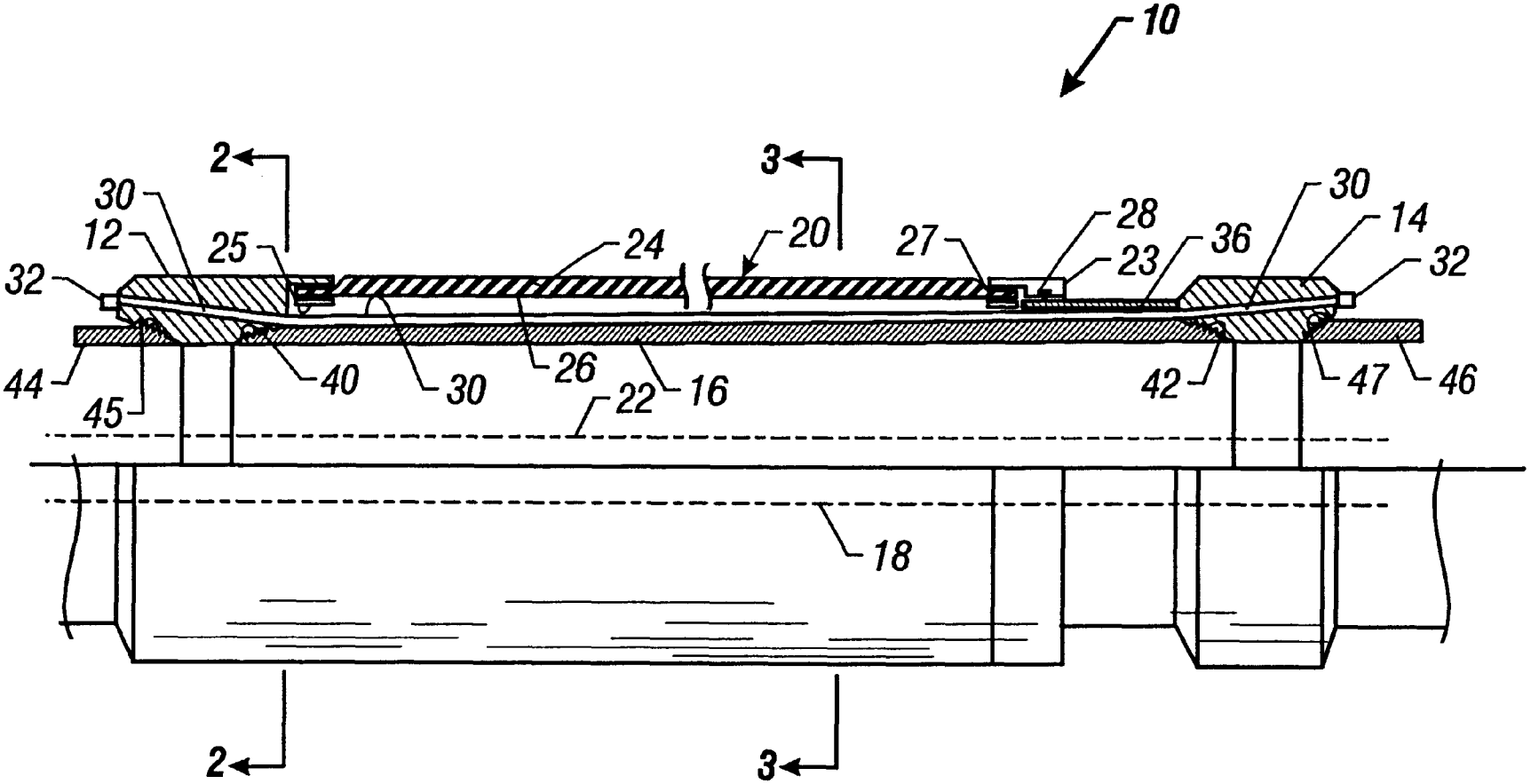
FIG. 1 is a longitudinal cross-section of the invention.

The packer unit 10 of FIG. 1 is illustrated to include a cylindrical packer mandrel 16 having a substantially circular cross-section about an axis of rotation 18. Pipe threads 40 at the upper end of the mandrel secure an assembly of the mandrel with the packer valve collar 12. Pipe threads 42 at the lower end of the mandrel secure the mandrel assembly with the bottom collar 14.

The invention example described herein is an independent tool designed to be combined in-line with other tools such as slips and production valves. The same fabrication principles may be applied to packer tools that are integrated with other tools such as slips as a singular unit. As an independent tool, however, the present packer unit 10 includes a top handling sub 44 assembled with the valve collar 12 by pipe threads 45 turned coaxially with the mandrel axis 18. The bottom handling sub 46 is assembled with the bottom collar 14 by pipe threads 47, also turned coaxially with the mandrel axis 18.

The expandable element of the packer 20 is shown in the present embodiment to be a collapsed tubular bladder having a flexible outer wall 24 and inner wall 26. The tube is closed upon itself about a cylindrical axis 22. The upper edge of the collapsed bladder is secured to the valve collar 12 by an upper collar ring 25 and to a lower sealing ring 23 by a lower collar ring 27. On the inner face of the lower collar ring 27 is an O-ring seal 28. A cylindrical sub 36 is secured to or is integral with the bottom collar 14. A sliding seal face of the sub 36 underlies the lower sealing ring 23 to cooperate with the O-ring 28 to mitigate contamination between the inner bladder wall 26.

Operatively, when the bladder 20 is expanded by pressurized fluid channeled between the outer and inner walls 24 and 26, respectively, the axial length of the bladder between the valve collar attached upper collar ring 25 and the lower collar ring 27 is reduced. The consequence of the axial length reduction is for the lower collar ring 27 to slide upward along the outer surface of the sub 36. The O-ring 28 maintains a sealed interface with sub 36 outer surface.

Figure 2:
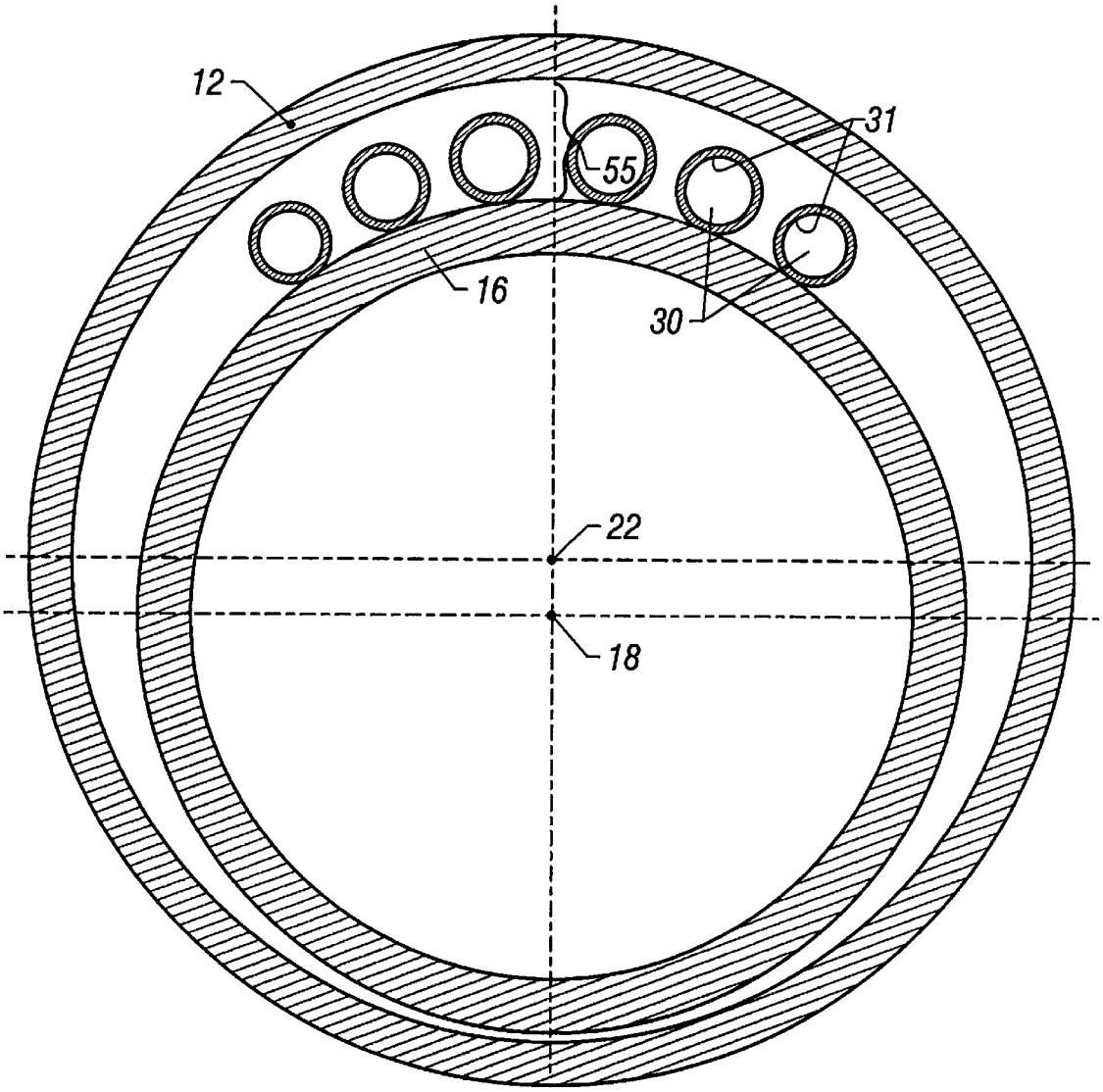
FIG. 2 is a cross-section of the invention as viewed into the cutting plane 2—2 of FIG. 1; and, FIG. 3 is a cross-section of the invention as viewed into the cutting plane 3—3 of FIG. 1.
Figure 3:
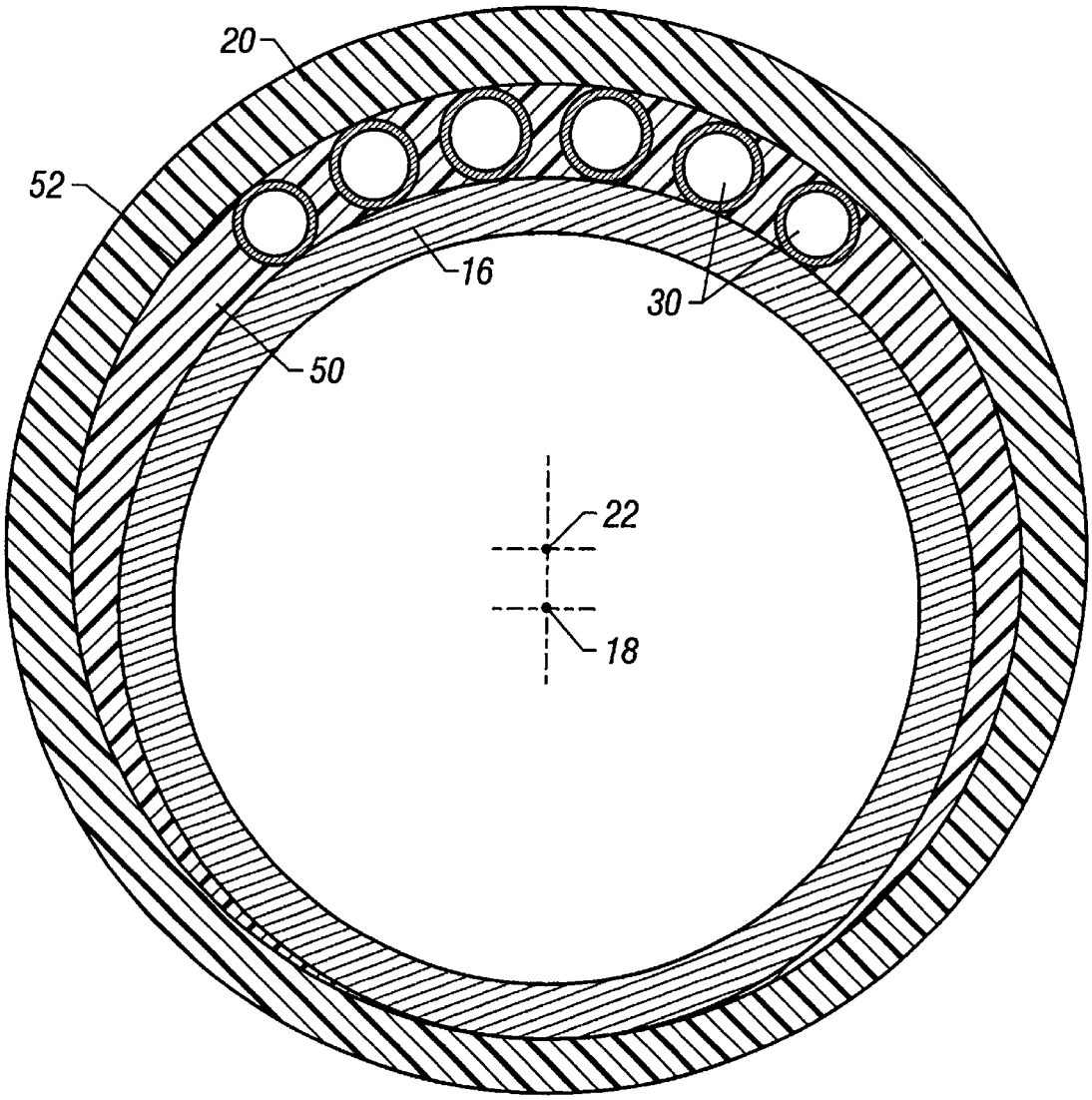

As will be observed from FIGS. 2 and 3, the cylinder circles of the mandrel 16 and the expandable element 20 are eccentric about respectively offset axes 18 and 22. This eccentricity creates an annulus between the mandrel and expandable element in the shape of a crescent. The crescent width at its mid-bight 55 (see FIG. 2) is approximately twice the radial width possible between a pair of coaxially aligned mandrels according to the prior art practice. Within the bight of this eccentric crescent is disposed one or more conduits 30; each of nearly twice the diameter available to the prior art. Each conduit 30 may be a continuous tube 31 from the outer edge of valve collar 12 to the outer edge of bottom collar 14 suitable for channeling electrical data transmission cable or fiber optic cable.

In such cases, the continuous tube is threaded through predrilled borings in the collars 12 and 14 and laid tightly against the outer surface of the mandrel 16. Alternatively, in the case of a direct fluid carrier, one or more of the tubes 31 may be terminated at opposite ends by fitting connectors 32.

Preferably, a compliant filler material 50 is either cast or troweled onto the surface of the mandrel 16 and into the spaces between the conduits 30 to develop an intermediate surface 62 that is approximately circular about the expandable element axis 22. This filler material may be an elastomer such as rubber or latex. Other options for the filler material may include various particulates such as fiberglass in an epoxy or polyester binder. Resultantly, the filler fairs the surface 52 over the conduits 30, binds the conduits tightly to the mandrel 16 surface and provides a measure of impact protection to the conduits.

The foregoing detailed description of our invention is directed to the preferred embodiments of the invention. Various modifications may appear to those of ordinary skill in the art. It is accordingly intended that all variations within the scope and spirit of the appended claims be embraced by the foregoing disclosure.

What is claimed is:

1. A packer for substantially isolating adjacent sections of a wellbore annulus comprising: a substantially cylindrical packer mandrel assembled with a valve collar and a bottom collar at opposite ends of a mandrel axis; an expandable wellbore sealing element disposed between said collars to eccentrically enclose said mandrel, said sealing element being substantially concentric about a cylindrical axis to form an eccentric zone between said collars, the sealing element axis being substantially parallel with and offset from said mandrel axis; at least one external conduit disposed between said collars and within said eccentric zone, said conduit having opposite ends connected to channels through respective collars.

2. A packer as described by claim 1 having compliant fairing material applied to said mandrel contiguously flanking said conduit.

3. A packer as described by claim 2 wherein said fairing material is formed to a substantially cylindrical surface about an axis substantially corresponding to said sealing element axis.

4. A packer as described by claim 2 wherein said fairing material is elastomer.

5. A packer as described by claim 1 wherein said conduit has fluid conduit connectors at opposite ends thereof.

6. A packer as described by claim 1 wherein said conduit is substantially open at opposite ends thereof.

7. A method of fabricating a wellbore annulus packer comprising the steps of:

a) providing an assembly combination having a valve collar and a bottom collar at respectively opposite axial ends of a cylindrical mandrel;

b) providing at least one continuous conduit through said collars and along the length of said mandrel; and, c) enclosing said mandrel and conduit by a cylindrical expansion element that is secured to at least one of said collars, an axis respective to said cylindrical expansion element being in parallel offset alignment with the axis of said cylindrical mandrel.

8. A method as described by claim 7 wherein said cylindrical expandable element is expanded by a pressurized fluid.

9. A method as described by claim 7 wherein said conduit is flanked by filler material along said mandrel surface.

10. A method as described by claim 7 wherein fluid conduit connectors are provided at opposite ends of said conduit.

11. A method as described by claim 7 wherein said conduit is a protective channel past said expandable element for an electrical data carrier.

12. A method as described by claim 7 wherein said conduit is a protective channel past said expandable element for an electrical data carrier.

* * * * *